US009412343B2

(12) United States Patent
Shankar

(10) Patent No.: US 9,412,343 B2
(45) Date of Patent: Aug. 9, 2016

(54) CONTINUOUS PITCH WIND MUSICAL INSTRUMENT AND A COMPOSITE STRING INSTRUMENT AND CONTINUOUS PITCH WIND MUSICAL INSTRUMENT

(71) Applicant: Sankarasubrahmani Uday Shankar, Murrysville, PA (US)

(72) Inventor: Sankarasubrahmani Uday Shankar, Murrysville, PA (US)

( * ) Notice: Subject to any disclaimer, the term of this patent is extended or adjusted under 35 U.S.C. 154(b) by 0 days.

(21) Appl. No.: 14/473,251

(22) Filed: Aug. 29, 2014

(65) Prior Publication Data

US 2014/0366703 A1 Dec. 18, 2014

Related U.S. Application Data

(63) Continuation-in-part of application No. 13/785,360, filed on Mar. 5, 2013, now Pat. No. 8,822,797, which is a continuation of application No. PCT/IN2011/000605, filed on Sep. 5, 2011.

(60) Provisional application No. 61/942,174, filed on Feb. 20, 2014.

(30) Foreign Application Priority Data

Sep. 6, 2010 (IN) ..... 2587/CHE/2010

(51) Int. Cl.
*G10D 1/00* (2006.01)
*G10D 7/00* (2006.01)
*G10D 15/00* (2006.01)

(52) U.S. Cl.
CPC .. *G10D 1/00* (2013.01); *G10D 7/00* (2013.01); *G10D 15/00* (2013.01)

(58) Field of Classification Search
CPC ..... G10D 1/00; G10D 7/026; G10D 15/00
See application file for complete search history.

(56) References Cited

U.S. PATENT DOCUMENTS

| | | | | | |
|---|---|---|---|---|---|
| 35,490 | A | * | 6/1862 | Schalkenbach | G10D 15/00 84/170 |
| 257,808 | A | | 5/1882 | Zimmermann | |
| 345,454 | A | * | 7/1886 | Skugrud | G10D 15/00 84/170 |
| 527,675 | A | * | 10/1894 | Enriquez | G10D 1/00 84/173 |
| 548,982 | A | * | 10/1895 | Van Gelder | 84/294 |
| 644,695 | A | * | 3/1900 | Stroh | 84/296 |
| 659,756 | A | * | 10/1900 | McCallip | G10D 15/00 84/170 |

(Continued)

OTHER PUBLICATIONS

The Dijbass, by Andy Graham, hosted by The Oddmusic Gallery, archived on Dec. 24, 2012.*

(Continued)

*Primary Examiner* — Robert W Horn
(74) *Attorney, Agent, or Firm* — Blynn L. Shideler; Krisanne Shideler; BLK Law Group

(57) ABSTRACT

A musical instrument includes a resonating pipe having a first slot defined along a length of a longitudinal axis of the resonating pipe and a sliding rod that slides along a length of the first slot and closes the first slot such that the sliding rod selectively covers and provides an air seal to the first slot, such that a pitch of sound produced varies according to a length of closure of the first slot. A mouthpiece is coupled to the resonating pipe to enable the player to create a resonating column of air in the resonating pipe and control the pitch of the instrument by controlling the coverage of the sliding rod over the first slot. A composite musical instrument may include the wind instrument combined with a stringed instrument.

17 Claims, 6 Drawing Sheets

(56) References Cited

U.S. PATENT DOCUMENTS

| | | | | | |
|---|---|---|---|---|---|
| 740,485 | A | * | 10/1903 | Tann | 84/294 |
| 753,327 | A | * | 3/1904 | Sprotte | 84/290 |
| 759,879 | A | * | 5/1904 | Griswold | 84/296 |
| 850,393 | A | * | 4/1907 | Northrop | 84/296 |
| 856,939 | A | * | 6/1907 | Bond | 84/296 |
| 896,790 | A | * | 8/1908 | Amundson | 84/296 |
| 906,407 | A | * | 12/1908 | Gillespie | 84/296 |
| 907,679 | A | * | 12/1908 | Buercklin | 84/296 |
| 921,507 | A | * | 5/1909 | Buercklin | 84/296 |
| 1,117,199 | A | * | 11/1914 | Lee | 84/295 |
| 1,184,221 | A | * | 5/1916 | Watty | 84/296 |
| 1,275,667 | A | * | 8/1918 | Feffetti | 84/296 |
| 1,301,147 | A | * | 4/1919 | Magin | 84/400 |
| 1,387,567 | A | * | 8/1921 | Vinson | 84/296 |
| 1,395,107 | A | * | 10/1921 | Hawk | 84/380 R |
| 1,417,174 | A | * | 5/1922 | Kalaf, Jr. | 84/296 |
| 1,429,954 | A | * | 9/1922 | Kummeth | 84/296 |
| 1,505,597 | A | | 8/1924 | Mann | |
| 1,556,950 | A | * | 10/1925 | Mann et al. | 84/380 R |
| 1,568,460 | A | * | 1/1926 | Legler, Jr. et al. | 84/380 R |
| 1,600,061 | A | * | 9/1926 | Pagett | 84/296 |
| 1,625,538 | A | * | 4/1927 | Hazell | 84/296 |
| 1,638,423 | A | * | 8/1927 | Ward | 84/296 |
| 1,643,044 | A | * | 9/1927 | Askelson | 84/296 |
| 1,665,402 | A | * | 4/1928 | Bothwell | 84/296 |
| 1,679,834 | A | * | 8/1928 | Lentz | 84/274 |
| 1,685,240 | A | * | 9/1928 | Nelson | G10D 15/00 84/170 |
| 1,693,924 | A | * | 12/1928 | Hillebrandt | 84/296 |
| 1,722,249 | A | * | 7/1929 | Lazare et al. | 84/380 R |
| 1,814,767 | A | * | 7/1931 | Pena | 84/296 |
| 1,885,672 | A | * | 11/1932 | Barredo | G10D 1/00 84/173 |
| 2,059,898 | A | * | 11/1936 | Osborne | 181/0.5 |
| 2,244,205 | A | * | 6/1941 | Koeder | 84/400 |
| D128,476 | S | * | 7/1941 | Berlin | D10/119.2 |
| 2,470,597 | A | * | 5/1949 | Guy | 84/400 |
| 2,544,033 | A | * | 3/1951 | Lawrence | 84/384 |
| 2,575,540 | A | | 11/1951 | Wenger | |
| 2,778,263 | A | * | 1/1957 | Ruben | 84/330 |
| 2,806,399 | A | * | 9/1957 | McBride | 84/386 |
| 3,142,222 | A | | 7/1964 | Polisi | |
| 3,202,031 | A | | 8/1965 | Polisi | |
| 3,599,526 | A | | 8/1971 | Sollecito et al. | |
| 4,305,322 | A | * | 12/1981 | Ray, Sr. | 84/173 |
| 4,320,686 | A | * | 3/1982 | Lewis | 84/380 R |
| 4,401,007 | A | | 8/1983 | Lewis | |
| 4,499,810 | A | * | 2/1985 | Ferron | 84/384 |
| 4,885,971 | A | * | 12/1989 | Ostendorf | 84/387 R |
| 5,133,238 | A | * | 7/1992 | Ostendorf | 84/387 R |
| 5,808,218 | A | | 9/1998 | Grace | |
| 6,139,393 | A | * | 10/2000 | Coleman et al. | 446/75 |
| 8,822,797 | B2 | * | 9/2014 | Shankar | 84/330 |
| 2002/0178892 | A1 | | 12/2002 | Lim | |
| 2013/0247745 | A1 | | 9/2013 | Shankar | |
| 2014/0366703 | A1 | * | 12/2014 | Shankar | 84/170 |

OTHER PUBLICATIONS

John W Coltman, Letters to the Editor, Compensating for miter bends in cylindrical tubing (L), May 2007, J. Acoust. Soc. Am., vol. 121, No. 5, pp. 2497-2498, 2007 Acoustical Society of America.

* cited by examiner

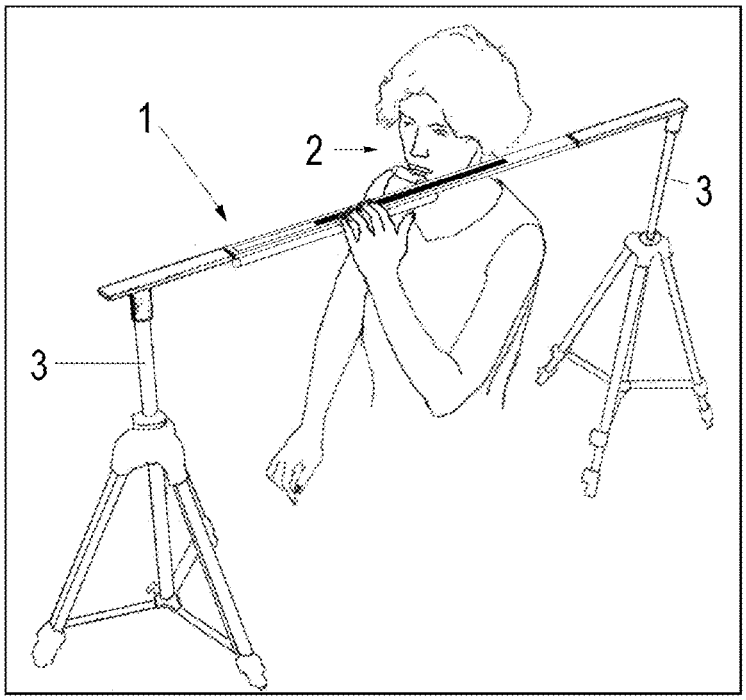
FIG. 1
FIG. 2
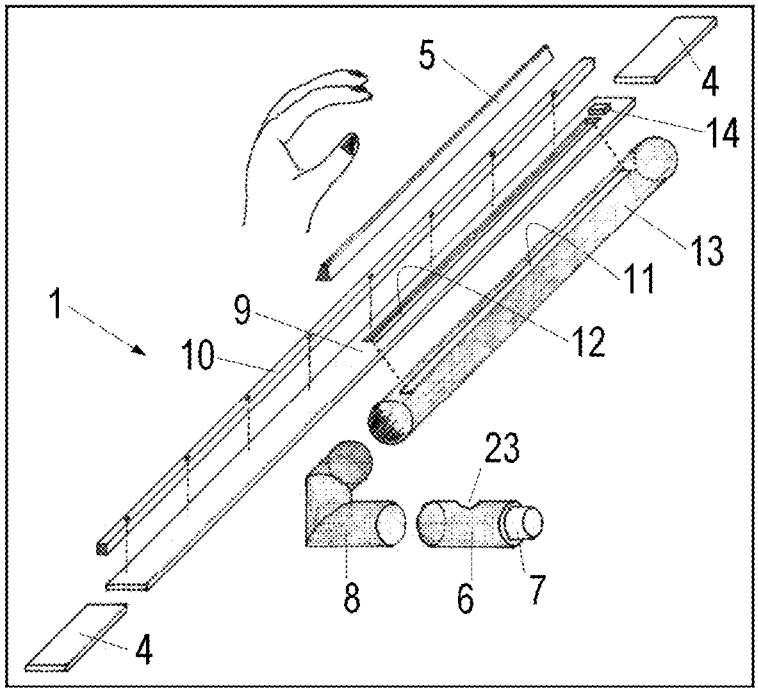

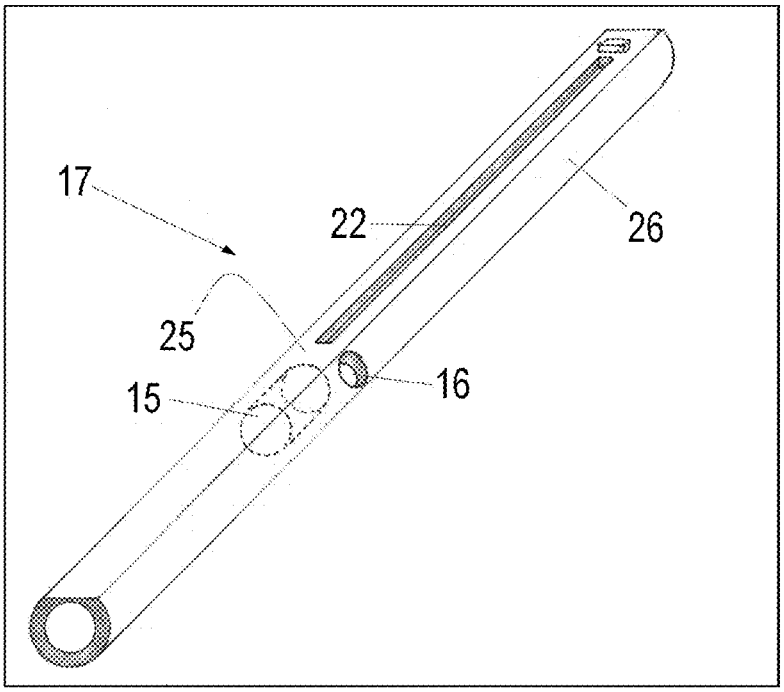
FIG. 3
FIG. 4
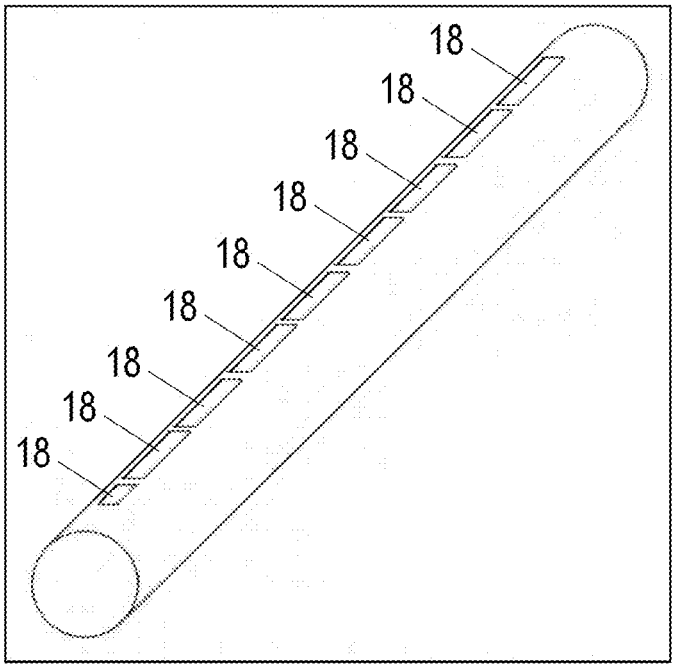

CONTINUOUS PITCH WIND MUSICAL INSTRUMENT AND A COMPOSITE STRING INSTRUMENT AND CONTINUOUS PITCH WIND MUSICAL INSTRUMENT

RELATED APPLICATIONS

This application claims the benefit of Provisional Application Ser. No. 61/942,174 filed Feb. 20, 2014 entitled "A Continuous Pitch Wind Musical Instrument and a Composite String Instrument and Continuous Pitch Wind Musical Instrument."

This application is a Continuation-in-part of U.S. patent application Ser. No. 13/785,360 filed Mar. 5, 2013; which published Sep. 26, 2013 as U.S. Publication Number 2013-0247745, which publication is incorporated herein by reference; which issued Sep. 2, 2014 as U.S. Pat. No. 8,822,797, which patent is incorporated herein by reference; and is entitled "A Continuous Pitch Wind Musical Instrument."

U.S. patent application Ser. No. 13/785,360 is a continuation of International Patent application serial number PCT/IN2011/000605 filed Sep. 5, 2011 entitled "A Continuous Pitch Wind Musical Instrument" which published on Mar. 15, 2012, as WO 2012/032539, which publication is incorporated herein by reference.

International Patent Application Serial Number PCT/IN2011/000605 claims the benefit of Indian Patent Application Serial Number 2587/CHE/2010 filed Sep. 6, 2010.

BACKGROUND OF THE INVENTION

1. Field of the Invention

The present invention pertains to a slide flute type of musical instrument, and, in particular, the present invention pertains to such an instrument with a wide octave range and fine control of the dynamic characteristics.

2. Background Information

Musical wind instruments fall into two major categories, namely open pipes and closed pipes. Open pipe musical instruments are resonant columns of air enclosed in a pipe with openings at both ends. Closed pipe instruments are resonant columns of air enclosed in a pipe with an opening at one end and sealed (i.e. "closed") at the other. The excitation to set either kinds of pipes into their resonant modes of vibration comes from one the following sources: i) a vibrating reed attached to the closed end, such as in the clarinet; ii) vibrating lips of the player, also called the "lip-reed", such as in the trombone and trumpet; and iii) simply "air reed", where a player blows a jet of air on to an edge of some sort at one end of the pipe. The flute and the recorder are common examples of "air reed" musical wind instruments.

The flute and recorder families are some of the most widely played open pipe instruments. In the case of the flute, the air jet is blown across the embouchure hole (or blow hole) towards its far edge. In the recorder, the jet is channeled toward an edge via a fipple. Clarinets, oboes, saxophones, and bassoons are closed pipe reed instruments, while brass instruments like trombones and trumpets are closed pipe "lip reed" instruments. The slide whistle, while classified as a toy, is also a closed pipe instrument (it is always closed at the piston end; the excitation comes from a recorder-like fipple at the other end).

The flute derives its open pipe characteristics from the fact that it is always open at the blow hole at one end while the other open end is either the first open tone hole, if any, or the open end of the pipe. The flute is excited into its resonant modes by the player blowing a rapid jet of air across the blow hole, which has a properly angled edge on the opposite side. The edge splits the air into two streams one of which escapes into the surrounding atmosphere while the other creates rotating eddies at the mouth of the blow hole. The rotating eddies in turn create acoustic pressure waves that are propagated along the length of the pipe. The angular velocity of the rotating eddies is a complex function of the blowing and the position of the player's lips with respect to the blow hole. When a critical angular velocity is reached that corresponds to the resonant frequency of the pipe for any given length, the pipe is spontaneously set into its resonant mode of vibration.

The pitch of the resonant mode of the flute is inversely related to the length of the vibrating air column. In a first approximation of flute theory of operation, the effective length of the vibrating air column is the distance from the blow hole to the first open tone hole. Thus by opening successive tone holes at greater distances from the blow hole, while keeping all other tone holes closed, the pitch of the fundamental resonant mode can be reduced in steps.

The operation of the slide whistle, variously also known as a "swanee" or "swannee" whistle, piston flute or jazz flute, is well known. It is a closed pipe instrument whose body consists of a cylindrical pipe, at one end of which is attached a recorder-like fipple for a mouthpiece. In some designs, the mouthpiece is flute-like, with a blow hole. The other end of the pipe is closed and air sealed by a movable piston that can slide up and down the length of the pipe. The position of the piston along the length of the pipe determines the length of the air column enclosed in the pipe. The pitch of the sound produced, as in all pipe instruments, is inversely proportional to the length of the air column.

In view of the ability to move the piston in a continuous manner thereby varying the length of the air column in a continuous manner, the slide whistle, in theory, provides continuously variable pitch control. However, during the actual playing of such an instrument by virtue of moving the piston up and down the pipe, the closed pipe causes conflicting air flow patterns and pressure variations at the mouthpiece, which provides the only inlet as well as outlet for the enclosed air, leading to unintended and random overtone generation and other pitch variations. Hence the sound produced by this instrument is often a medley of tones and pitches, quite unsuitable to play serious music and, hence, it is classified as a toy. Quite apart from these limitations, the inherently sluggish movement of a piston type of arrangement does not lend itself to fine dynamic control.

U.S. Pat. Nos. 4,320,686 and 4,401,007, which are incorporated herein by reference, disclose an open pipe wind instrument with a continuously variable pitch control, hereinafter referred to as slide flute. The relevant features of this instrument include: a pipe with a slot running along some part of its length; and a method to selectively cover the slot up to any point along its length. In one embodiment, the method used to seal the slot up to any point along its length is accomplished by means a flexible or pliable strip of material attached to the body of the flute. The user must run a finger back and forth over the strip and press it down at the desired point on the slot covering it up to that point. The instrument disclosed this patent, while providing a practical viable flute design, is inadequate in providing the required dynamic performance and control as well as air seal. This inadequacy persists regardless of the type of flexible strip used, for example a flexible magnetic strip or a thin strip of bendable wood. As a result, sliding or continuous pitch flutes of this kind neither consistently produce the desired pitch nor allow for the desired fine dynamic control and hence are musically unviable.

U.S. Pat. No. 2,806,399, which is incorporated herein by reference, discloses a wind musical instrument with a "helical frequency determining means" wherein a cooperating member is rotated relative to the resonating pipe to vary the effective pipe length. This rotational design is not considered to practically yield the desired control or sound quality needed in the art.

U.S. Pat. No. 2,544,033, which is incorporated herein by reference, discloses a "slide flute" design developed in the late 40s to be capable of being carried in a person's pocket and attempts to design a open hole embouchure yielding "fully responsive lip control" for a meaningful musical instrument rather than a toy.

U.S. Pat. No. 2,575,540 discloses a musician and wind instrument support combination specifically a combination chair and support for sousaphone that was also developed in the late 40s.

U.S. Pat. Nos. 3,142,222 and 3,202,031, which are incorporated herein by reference, discloses a bassoon design from the early 60s developed to "improve the mechanical features of the bassoon" to facilitate the playing of the wind instrument.

U.S. Pat. No. 3,599,526 discloses an "easy find" embouchure attachment to flute or piccolo and like instruments which enables a user to automatically find the proper placement of embouchure relative to lower lip placement and blowing angle.

U.S. Pat. No. 5,808,218 discloses a mid 90s development of an "expressive" musical wind instrument, such as a flute, "with which accurate pitch can be played easily" wherein a data storage memory responds by outputting a fine-tuning signal specifying a predetermined amount of frequency-tuning bias appropriate for a user selected note.

U.S Publication 2002-0178892, which is incorporated herein by reference, discloses a mechanism which controls the timbre and the volume of flute sound. A blocking piece is positioned behind a cork piece in the head joint which forms a flute along with the body and the foot joint, and a connecting piece is installed on the control cap in a spiral assembly. The oscillation wave caused by the air pressure inserted through the mouthpiece of the head joint goes through the cork and is transferred to the blocking piece and the connecting piece with different weights reflecting some part of the wave and absolving the other at the same time. Thus this wave will change into different oscillating waves resulting in a variety of possible tone color and volume.

The above collection of listed patents and applications disclose teachings regarding wind instrument construction that are helpful in understanding the general scope content and knowledge of the prior art. All of the above mentioned patents are incorporated herein by reference.

It is an object of the present invention to overcome the deficiencies of the prior art and a provide slide flute type of musical instrument, both of the closed-pipe slide whistle/flute design and of the open-pipe design, with a wide octave range and fine control of the dynamic characteristics.

SUMMARY OF THE INVENTION

The object of the present invention is achieved according to one embodiment of the present invention by providing a slide flute type of musical instrument that includes a resonating pipe having a first slot defined along a length of a longitudinal axis of the resonating pipe. A rigid rod hereinafter referred to as sliding rod, is provided that slides along a length of the first slot and seals the first slot such that the sliding rod selectively closes and provides an air seal to the first slot. A mouthpiece is coupled to the resonating pipe to enable the player to create a resonant column of air in the resonating pipe, i.e., the musical sound. The pitch of the musical sound thus created is determined by the extent to which the sliding rod closes the first slot.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

The features that characterize the present invention are pointed out with particularity in the claims which are part of this disclosure. These and other features of the invention, its operating advantages and the specific objects obtained by its use will be more fully understood from the following detailed description and the operating examples.

BRIEF DESCRIPTION OF THE FIGURES

FIG. 1 is a view of the integrated assembly of a slide flute type of musical instrument of one embodiment according to the principles of the present invention;

FIG. 2 is an exploded view of a slide flute type of musical instrument according to the principles of the present invention;

FIG. 3 is a perspective view of an alternative embodiment of portion of the slide flute type of musical instrument according to the principles of the present invention;

FIG. 4 is a perspective view of an alternative embodiment of portion of the slide flute type of musical instrument according to the principles of the present invention;

DESCRIPTION OF THE PREFERRED EMBODIMENTS

Figure 5A:
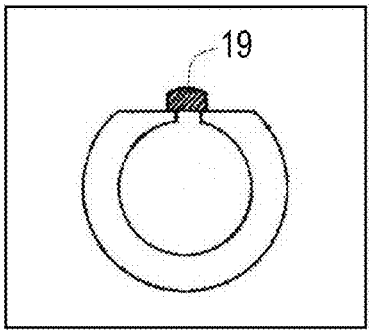
FIGS. 5A and 5B are cross-sectional views of portion of the slide flute type of musical instrument according to further embodiments of the present invention.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. The phrase "slide flute type" will reference "continuous pitch wind instruments" and the phrases may be effectively used interchangeably herein.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 is a view of the integrated assembly of the slide flute type musical instrument 1 of the invention being played by the player 2. The assembly includes the musical instrument 1 and mounting stands 3. Other details are discussed subsequently.

FIG. 2 is an exploded view of a slide flute type of musical instrument 1 according to the principles of the present invention. Musical instrument 1 includes a resonating pipe 13, a slide plate 9, a guide wall 10, a sliding rod 5, a head-joint 8, a mouthpiece 6, mouthpiece sealing cork 7 and mounting extensions 4, further details of which are discussed below.

Musical instrument 1 is a melodic wind musical instrument capable of producing a continuum of pitches. The continuum of pitches produced by the musical instrument 1 is highly suited to playing Indian classical music both of the Carnatic (South Indian) and Hindustani (North Indian) variety, according to a particular aesthetic philosophy dominant in Indian classical music called "gaayaki ang", which can be translated as "vocal style". Indian classical music is typically performed by very small ensembles of one or two vocalists or instrumentalists and one or more percussionists. The "gaayaki ang" aesthetic philosophy dictates that Indian instrumental music should be aimed at mimicking vocal music to the best extent possible and replicating the standard vocal repertoire on the instrument. Consequently, the "gaayaki ang" aesthetic philosophy may be a primary consideration for the design of any new instrument in the Indian context, such as musical instrument 1.

Indian classical music is based on a set of discrete notes similar to western music. However a major difference is the Indian aesthetic that mandates the ability to glide smoothly between notes separated by small or large intervals, as well as the ability to create smooth modulations around any individual note. Therefore, ideally, Indian classical music calls for a complete continuity of pitch, as well as the ability to control pitch movement with great rapidity and precision. All of these are achieved by the musical instrument 1 of the present invention.

Among melodic wind instruments (as opposed to string instruments), only the trombone and the slide whistle offer continuity of pitch. The latter is of limited range and of non-musical tonal quality, and, hence, can be classified as a toy. The trombone is not very well suited for Indian music because it does not allow for the desired fine dynamic control, as well as the fact that it offers less than a single octave range without over-blowing. Over-blowing cuts the continuity at the point of transition from normal to over-blowing. Thus, the present invention fills a clear void in the type of instruments currently available for playing Indian classical music.

With reference to the exemplary embodiment shown in FIG. 2, resonating pipe 13 is approximately half meter long and is a thin-walled pipe of circular cross section with a small slot 11 starting at or a small distance from one end and ending at or about the same distance from the other end. In an exemplary embodiment, slot 11 is about 4 mm wide. The present invention contemplates, and described in further detail later in this document with respect to the exemplary embodiment shown in FIGS. 7A and 7B, other embodiments wherein the width of the slot can be adjusted to any desired width in a certain range in order to optimize for best tonality according to the player's preference.

With reference to the exemplary embodiment shown in FIG. 2, resonating pipe 13 is clamped or otherwise coupled to the bottom surface of a slide plate 9, wherein the slide plate 9 is structured as a straight and rigid rectangular flat bar having a corresponding through-hole slot 12, of identical length and width to slot 11, running along part of its length. During assembly, the two slots 11 and 12 are exactly aligned and any gaps at the junction of pipe and plate sealed so that the two slots constitute a unitary slot opening into the inner chamber of the resonating pipe 13. The top surface of slide plate 9 is flat and smooth. Resonating pipe 13 ends some way along slide plate 9, at which point a head-joint 8 is attached to the resonating pipe and to the head-joint 8 is attached the mouthpiece 6.

The instrument 1 of the present invention addresses the sealing and dynamic performance problems discussed above with respect to the prior art such as in the '686 patent, by using an independent external sliding rod 5, described in further detail below, that smoothly slides over the sliding plate 9 to selectively close the slot to any particular distance. Precise longitudinal straightness and rigidity of the two sliding surfaces together with an exact matching of their mating profiles ensures an air seal that remains unbroken during operation.

Figure 5B:
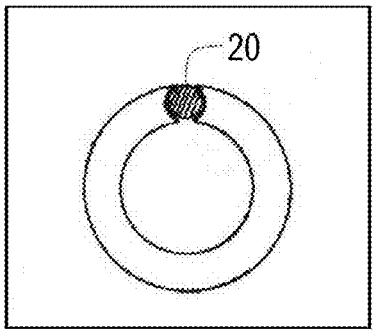

FIGS. 5A and 5B illustrate two embodiments of mating profiles. As regards dynamic performance, the following features taken together ensure fine dynamic control: i) the sliding surfaces are coated with a suitable material of a low coefficient of friction ensuring smooth sliding operation; ii) the use of a suitable lubricating sealant further reduces friction as well as improves seal; and iii) the sliding rod is designed to be of optimal weight that balances light weight and required inertia.

The musical instrument 1 of the present invention is generally based on the principle of the flute. It has many features found on the flute, such as the resonating pipe and blow hole. However, instead of having a discrete set of tone holes, it has a continuous slot running along the length of the pipe. Slot can be understood as a sort of integrated set of tone holes that spans a whole range of pitches in continuum. The slot can be closed (i.e., air sealed) to any distance from the blow hole by the sliding rod.

FIG. 3 shows an embodiment of a unitary resonating pipe and slide plate assembly 17, wherein the two parts are integrated into a single thick-walled pipe shaved off to have suitably wide flat surface on top. The head-joint is attached to a hole 16 on the side of the resonating pipe. The non-slotted portion of the resonating pipe is sealed off with a stopper 15 on the inside beyond the position of the end of the slot and the hole on the side. Hereafter, the sealed off part of the pipe serves no acoustic purpose and serves simply as a support for the surface or profile on which the sliding rod 5 can slide on.

The correspondence of the parts in the unitary embodiment 17 depicted in FIG. 3 with those described in the discrete embodiment of FIG. 2 is as follows:

1. the single slot 22 in the unitary embodiment 17 constitutes an integration of slots 11 and 12 described earlier with respect to FIG. 2;
2. the top surface 25 of unitary embodiment 17 corresponds to the top surface of the slide plate 9 described earlier with respect to FIG. 2; and
3. the resonating pipe 26 of this unitary assembly corresponds to resonating pipe 13 described earlier with respect to FIG. 2.

While resonating pipes of circular inner cross section are exclusively described here, it is to be understood that all possible internal and external cross sections are covered including but not restricted to square, hexagonal, octagonal and oval.

FIG. 4 shows another embodiment wherein the slot on the pipe as well as the slide plate or the combined embodiment thereof can be a series of linearly aligned smaller slots 18 instead of one continuous slot. The positions and dimensions of these individual smaller slots are selected such that some suitable point along any given slot corresponds to some key nodal point on a musical scale around which continuous pitch modulations are deemed desirable in some given musical aesthetic.

With reference to FIG. 2, a head-joint 8 is attached to that end of resonating pipe 13 that is near the middle of the slide plate 9 (i.e., the end that is at the point where the slot in the slide plate ends). The head joint 8 is a suitably bent pipe that serves as a conduit between the resonating pipe and the mouthpiece 6, to be described later. The head-joint 8 is bent or curved in such a way that after attaching it to the pipe 13, its free end as well as the mouth piece 6 which is attached to it, together make an optimal angle to the length of the resonating pipe 13 and slide plate 9 assembly.

The angle made by the free end of the head-joint 8 and the mouthpiece 6 combination to the length of the resonating pipe 13 and slide plate 9 assembly is optimized for two opposing needs. On the one hand, given the small combined lengths of the head-joint 8 and mouthpiece 6, this angle is sufficiently askew of perpendicular so that the mouthpiece 6 can be accessed conveniently by the mouth of a player 2 approaching the assembly from a side, without the assembly obstructing one side of the player's face from such an approach. On the other hand, the angle is close enough to the perpendicular in order to i) permit the player 2 to use an optimal front to back motion of the arm for sliding the sliding rod, and ii) permit the player to view the slide plate 9 optimally along its length for clear visual feedback required for accurate slide placement. In a preferred embodiment this angle is about but not restricted to 110 degrees for a side blown, flute like, mouthpiece. It is different for other types of mouthpieces which are blown from the end instead of the side.

In the context of the bent design of the head-joint 8, it is to be clearly understood that a resonant musical pipe need not necessarily be straight. Pipes with smoothly curved bends are acoustically very similar to straight pipes of similar overall lengths. The design of many brass instruments such as trumpets, horns and trombones has relied on this principle. Research, such as that described in "Compensating for Miter Bends in Cylindrical Tubing (L)", John Coltman, Journal of the Acoustic Society of America, Vol. 121, No. 5, May 2007, pgs 2497-2498, has shown that sharp miter bends in pipes can be acoustically compensated to behave similar to straight pipes.

FIG. 2 shows one embodiment of the head-joint 8 with two mitered bends that are appropriately acoustically compensated. Other embodiments of the head-joint 8 can have smoothly curved bends.

Mouthpiece 6 is attached to the free end of head-joint 8. One embodiment of the mouthpiece depicted in FIG. 2 is flute like: a short rigid tubular chamber with the blow hole 23 at an appropriate distance from the attached end. In order to minimize over-blowing octave inharmonicity across the entire range, the inside surface of the head-joint mouthpiece and some part of the resonating pipe 13 is suitably tapered in combination, using well-established flute head-joint design techniques.

The free end of the mouthpiece is sealed with a cylindrical piece of cork 7 or other material. The end surface of the cylindrical piece of cork 7 that is inside the pipe is adjusted to be positioned appropriately per standard flute practice.

In one embodiment, the combined distance from the slot to the mouthpiece is minimized as much as possible in order to maximize the pitch of the fundamental mode when the slot is completely open. This forms a kind of upper bound on the pitch that can be produce in any practical implementation of such an instrument. In an exemplary embodiment, the distance is about 3 to 4 cm, which results in a fundamental pitch of about 5 kHz which falls close to D8#.

In an exemplary embodiment, mouthpiece 6 can be adjusted by axial rotation such that the blow hole 23 is properly aligned with the players lips. Either squatting on the floor as in Indian ensembles or sitting on a chair as in Western ensembles, the player 2 aligns lips to the blow hole 23, while bringing arm under and over the resonating pipe—slide plate 9 assembly and resting hand on top of sliding rod 5. The effort to slide the sliding rod 5 back and forth is made using exclusively the movement of the arm at the shoulders and elbow. The top surface of the sliding rod 5 is made sufficiently rough and anti-slip to prevent any relative movement between the hand and the sliding rod 5.

In the embodiment shown in FIG. 1 and FIG. 2, at the two ends of slide plate 9, mounting extensions 4 are bolted or otherwise attached to the slide plate 9. Mounting extensions 4 extend the length of the overall assembly of the instrument 1 so that when the assembly is mounted on two tripod stands 3, the player's body parts are not in the way of the tripod stands 3.

In the exemplary embodiment shown in FIG. 1 and FIG. 2, the entire assembly is mounted at the two ends on two adjustable height mounting tripod stands 3. This mounting, or some associated support, is essential because the entire assembly is hard and awkward to hold with one hand and keep the mouthpiece aligned to the mouth while manipulating the slide with the other hand. Additionally, in this preferred embodiment, it is suitable that the assembly is held horizontal for optimal performance. The heights of the tripods are adjusted to the convenience of the player such that the mouthpiece 6 is aligned with the lips of the player 2 and the assembly remains horizontal. In other embodiments where the sliding rod 5 is not a free standing element but mounted on bearings, the horizontal orientation of the assembly is not necessary. An alternative support or mounting structure would be a harness or strap arrangement around the neck and shoulders of the user to allow for a portable instrument.

Figure 6:
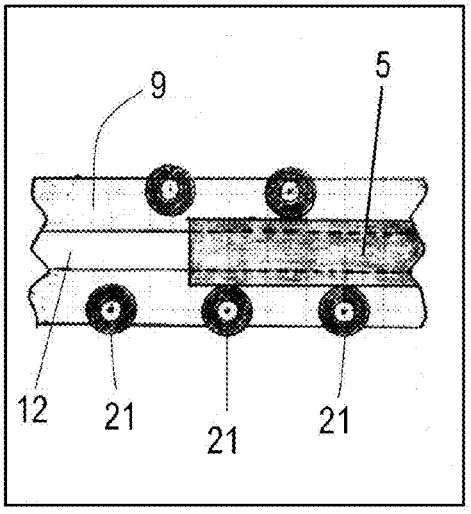
FIG. 6 is a plan view of an alternative embodiment of portion of the slide flute type of musical instrument according to the principles of the present invention.

In a p referred embodiment shown in FIG. 2, the guide wall 10 is a smooth square-section rod that is attached to the slide plate 9 on one side of the slot. In another preferred embodiment, two identical square-section rods are attached to each side of the slot thereby forming a "guide channel". In yet another preferred embodiment shown in FIG. 6, there are series of guiding wheels 21 on both sides of the slot 12 which can be rigid or rotating; in order to reduce the contact friction further, the number of guiding wheels is minimized by arranging them in a zigzag manner on either side of the slot 12.

The sliding rod 5 is of a suitable cross-section with at least one surface profile all along its length which is matched by an identical profile on the slide plate 9 such that when the two are aligned to each other, the rod 5 can cover the slot and maintain an air seal. By sliding the rod 5 up and down along the length of the slot, the extent to which it covers the slot can be varied.

The profiles of the mating surfaces on the sliding rod 5 and slide plate are exactly matched to ensure air-seal as well as smooth sliding. Several embodiments are possible. FIG. 5A and FIG. 5B show two examples of profiles. FIG. 5A shows a sliding rod 19 of arbitrary cross section with a flat bottom surface that provides the necessary air seal by mating with the flat surface on the slide plate adjacent to the slot. FIG. 5B shows an embodiment wherein the sliding rod 20 is of circular cross section and the slide plate has a corresponding curvature.

In the embodiment shown in FIG. 2, the sliding rod 5 is placed on the slide plate 9 and held aligned and flush with the guide wall 10. The player is guided by the guide wall to keep the sliding rod 5 aligned in its position over the slot 12 as well as in its movement along the length of the slide plate. Sliding the sliding rod along the length of the slot changes the extent to which the sliding rod 5 closes the slot. The mating surfaces on the slide plate 9 and the sliding rod 5 are coated with such materials that minimize the mutual coefficient of friction.

In the embodiment depicted in FIG. 2, the length of sliding rod 5 is slightly more than the length of slot 12, so that it in one particular position it can close and seal off the slot 12 completely. The stopper 14, a little beyond the end of the slot 12, marks this position and prevents the rod 5 from sliding accidentally beyond the end of the slot 12. This is the position of maximal length for the resonating column and, hence, produces the lowest fundamental mode pitch. At the other extreme, the sliding rod 5 can be slid up so it opens the slot 12 completely. This is the position of minimal length for the resonating column, wherein the resonating column only spans the distance from the blow hole 23 to the start of the slot 12. This position produces the highest fundamental mode pitch.

In the embodiment depicted in FIG. 2, the top of sliding rod 5 is suitably surfaced for non-slip contact with some part of the player's hand, such as but not restricted to fingertips. The latter is held against the non-slip top surface of the sliding rod to move it up and down the slide plate 9. Other embodiments can have handles or finger rings attached to the sliding rod 5 to help the player's fingers get a firm grip on it.

A lubricating sealant is applied to the mating surfaces of the slide plate 9 and sliding rod 5. It facilitates the smooth movement of the sliding rod 5 along the slide plate 9. In addition it helps improve the seal.

In one embodiment depicted in FIG. 1 and FIG. 2, the instrument 1 is played by blowing across the blow hole 23 situated on the mouthpiece 6, in a lateral manner familiar to flutists; simultaneously the pitch is altered in a continuum by moving the sliding rod 5 back and forth along the length of the slot 12. As the sliding rod 5 slides "down" the slide plate 9, i.e., towards the mouthpiece end, the pitch is increased and vice versa. Staccato musical passages consisting of discrete notes can also be played by blow control, i.e., by cutting the blow at appropriate times during sliding between notes.

In an exemplary embodiment, along the length of the slide plate 9 markings are made corresponding to various pitches. Another marking is made on some suitable spot on the sliding rod 5 such that when that marking is aligned to any one of the markings on the slide plate, a predetermined pitch is produced. This visual feedback helps the player manipulate the sliding rod 5 to the correct spot. In addition, a practice mirror can be mounted on a stand opposite the player 2 and suitably angled to provide visual feedback while practicing to play the instrument 1.

In an enhanced embodiment, by adding a bent U-tube at the free end of the resonating pipe 13, i.e., the end opposite to the one at which the head-joint 8 is attached, the flute can be extended to a parallel resonating pipe and slide plate assembly, operated by another sliding rod. While operating this second sliding rod, the first sliding rod 5 is positioned such that the slot 12 on the first slide plate 9 is closed completely. This mechanism will extend the range of the instrument 1 of the present invention even further, to the very low octaves of the woodwind family.

In an exemplary embodiment shown in FIG. 1, the entire assembly is mounted on tripods 3 or other suitable stands, and only one hand of the player 2 is required to operate the instrument 1. Also, no finger dexterity is required as the sliding rod 5 can be moved through the action of the user's arm. This makes the instrument 1 highly viable for various people handicapped in different ways or otherwise lacking in finger dexterity.

In an exemplary embodiment shown in FIG. 1 and FIG. 2, the head-joint 8 and mouth piece 6 assembly is positioned such that the player 2 sits with the resonating pipe 13 and slide plate 9 assembly to her left and operates the slide 5 with her left hand and arm. It is equally possible to turn the head-joint mouthpiece assembly to the opposite side such that the player 2 sits with the resonating pipe 13 and slide plate 9 assembly to her right and operates the slide with her right hand and arm.

Figure 7A:
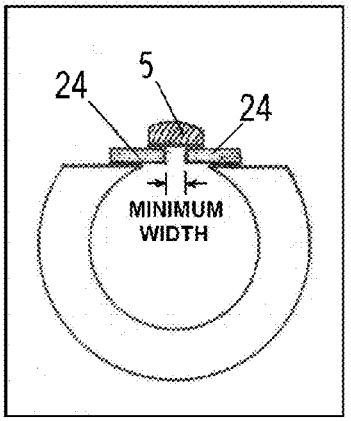
FIGS. 7A and 7B are cross-sectional views of portion of the slide flute type of musical instrument, according to further embodiments of the present invention.
Figure 7B:
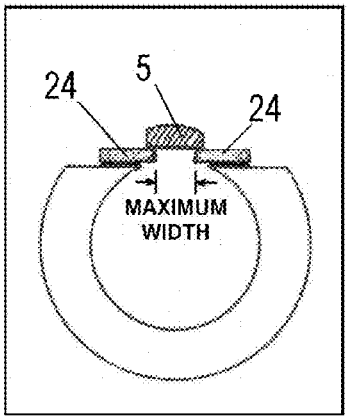

FIGS. 7A and 7B show cross sectional views of an exemplary embodiment wherein the width of the slot is adjustable. Instead of a single slide plate with a slot, these embodiments consist of a set of two parallel slide plates 24 resting on a resonating pipe 13 with a large slot. The sliding rod 5 rests on top of the two slide plates 24, bridging the gap between the two plates 24. The gap between the two slide plates 24 constitutes a de facto slot; the separation between the two slide plates 24 can be understood as the slot width. This width can be increased or decreased within a range. FIG. 7A shows a position of minimum width and FIG. 7B shown a position of maximum width.

Figure 8:
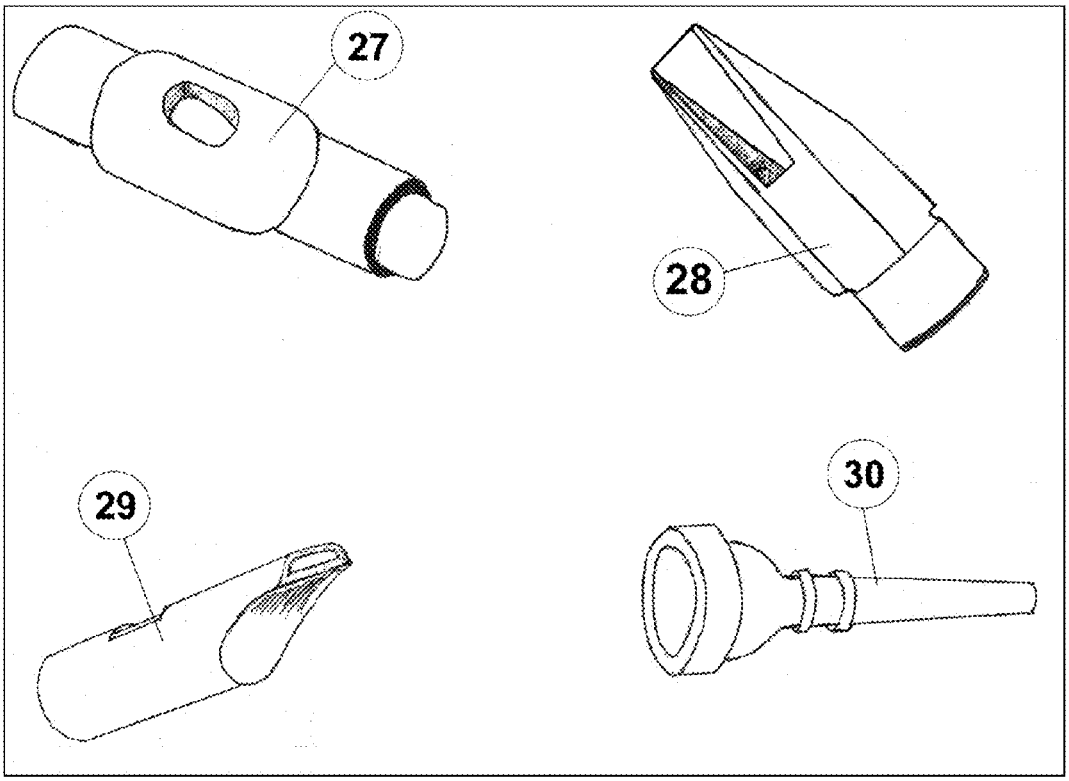
FIG. 8 is a perspective view of different embodiments of portion of the slide flute type of musical instrument, according to the principles of the present invention.
Figure 9A:
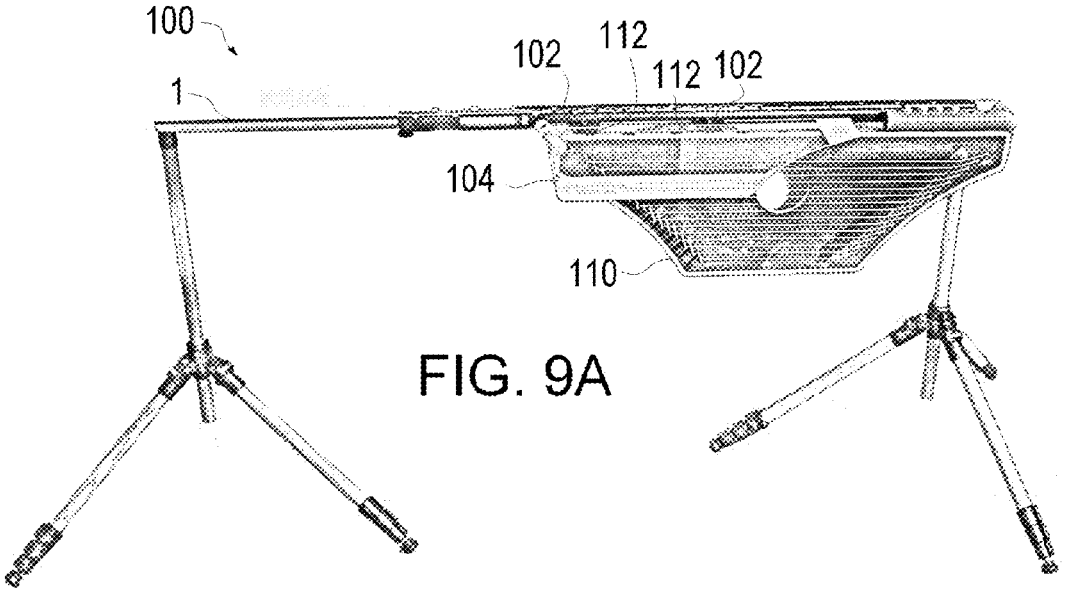
FIGS. 9A-D are perspective views of a composite string instrument and slide flute type of musical instrument of one embodiment according to the principles of the present invention.
Figure 9C:
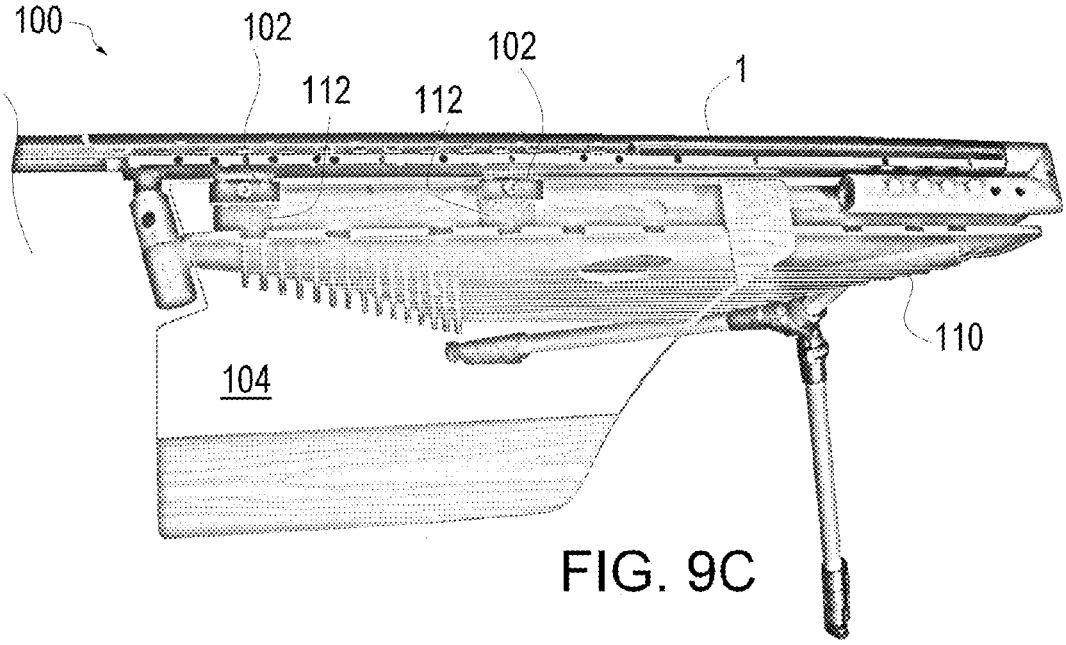
Figure 9B:
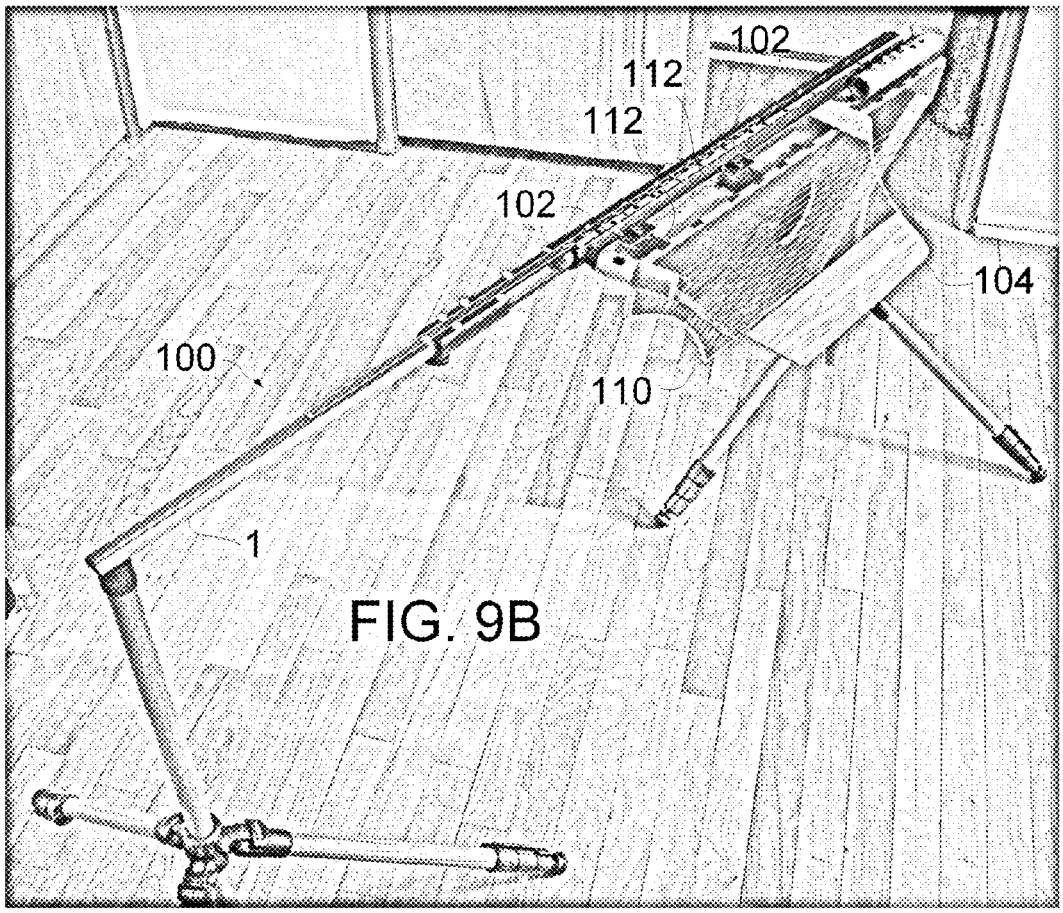
Figure 9D:
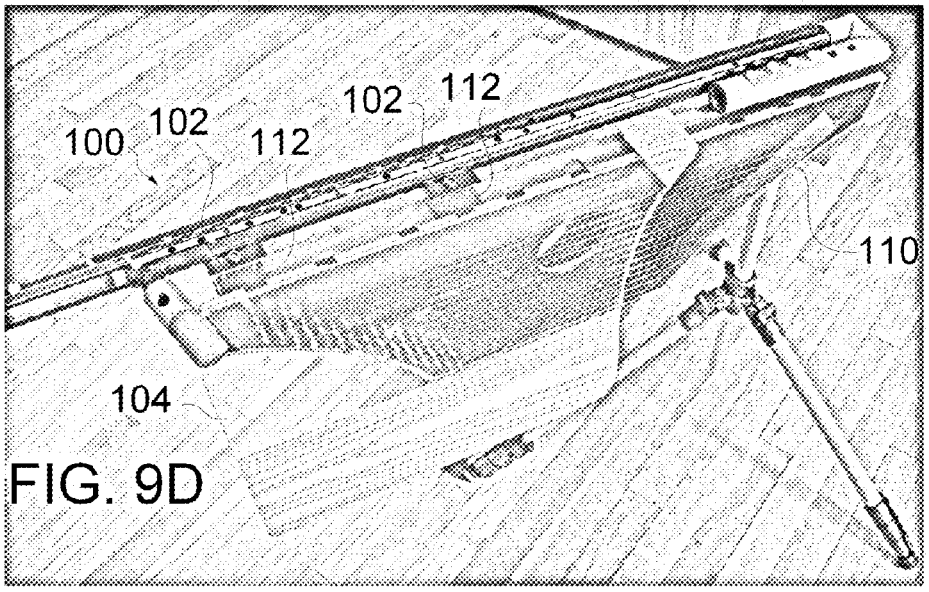

FIG. 8 shows perspective views of exemplary embodiments of four types of mouthpieces, that can be coupled to the head-joint 8 for creating different timber and tonal qualities: i) flute-like "air reed" mouthpiece 27; ii) clarinet-like vibrating reed mouthpiece 28; iii) recorder-like fipple 29; and iv) trombone-like lip reed arrangement 30. It is to be understood that each type of mouthpiece will have own embodiment of headjoint, in each case properly angled for ease of the player's access to the mouthpiece.

While some specific embodiments and methods for replicating this invention have been described in detail, those skilled in the art of musical instrument design will recognize other obvious manifestations and details that could be extrapolated in light of the information disclosed herein. Therefore, the particular arrangements in this disclosure are meant to be illustrative only and not to limit the scope of the invention which is to be given the full breadth of the following claims and all equivalents thereof.

It can be appreciated from the foregoing, that musical instrument 1 is an open or closed pipe type of slide flute that provides the following advantageous features: 3 octaves of continuous pitch without the need for over-blowing; At least 4.5 octaves with over-blowing; An externally manipulated sliding rod that enables instantaneous response to rapid tactile manipulations suitable for fast musical passages in many genres, particularly Indian Classical Music; Mounting stands of adjustable height that allow for: (i) playing the slide flute squatting on the floor as in Indian ensembles or sitting on a chair as in western bands and ensembles, and (ii) freeing up one arm and hand for other activities like keeping time (Indian music), conducting or operating other instruments; A bent head-joint that is mounted at a suitable angle to the main pipe for easy access and suitably tapered on the inside for proper over-blowing octave accuracy; An adjustable mouthpiece that allows for proper angle of blowing regardless of posture or mouth angle; The provision to attach a second vibrating column via a U-tube along with a second sliding rod thereby increasing the range of the instrument even further to more than 5 octaves without over-blowing; and the provision to attach a vibrating reed-blower mouthpiece thus converting it into a slide-clarinet type of instrument or a lip-reed mouthpiece thus converting it into a trombone-like instrument or a fipple thus converting it into an open-pipe slide whistle type of instrument.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

FIGS. 9A-D are perspective views of a composite string instrument and slide flute type of musical instrument 100 of one embodiment according to the principles of the present invention. The term composite is referencing the combination of two instruments 1 and 110, and may also be referenced as an "integrated" or a "combined" string instrument and slide flute type of musical instrument 100. As shown the composite instrument 100 of FIGS. 9A-D utilizes the continuous wind instrument 1 described above in connection with FIGS. 1-8 and the details of the instrument 1 are not repeated.

The composite musical instrument 100 includes a pair of spaced mounting brackets 102 coupled to the pipe 13. The mounting brackets 102 allow for the coupling of a horizontal sound directing baffle 104. The addition of the baffle 104 helps improve the sound quality or tone from the instrument 100, particularly from the pipe 13. Placing suitable baffles, such as 104, in the proximity of the mouthpiece 6, the acoustic feedback to a wind instrument player is enhanced. In the composite instrument 100 it is beneficial if the baffle 104 is transparent in substantial portions thereof for the ease of the operator in working with the string instrument 110.

The mounting brackets 102 also allow the coupling of the string musical instrument 110 to the instrument 1 to form the composite instrument 100 as shown. Threaded aluminum blocks 112 coupled to the body of the string musical instrument serve as an effective coupling mechanism. It is advantageous if the mounting brackets 102 include a vibration isolation to prevent mechanical vibration from propagating through the brackets 102 to the string instrument 110. Vibration isolation may be through an intervening rubber type layer, such as even tape.

Similar vibration isolation may be provided between the brackets and the baffle 104 to prevent visible oscillation of the baffle 104. In the attached figures, the string instrument 110 is mounted to rest in a generally vertical orientation, with the strings stretching in a horizontal direction substantially parallel to the pipe 13. Other orientations are possible, depending on the primary functions of the strings, to be discussed shortly, i.e., provide sympathetic resonance, plucked by the player or bowed by the player. In such instances, it may be preferable to have the strings stretched in a vertical direction, similar to harp type instruments. In another embodiment, the stringed instrument 110 can be placed as a standalone piece, placed in close proximity to the player and the instrument 1, with the strings oriented appropriately.

The continuous pitch musical instrument 1 of the composite musical instrument operates in the manner described above and, as set forth above, allows to the user to seamlessly glide smoothly between notes separated by small or large intervals, as well as the ability to create smooth modulations around any individual note providing the user with a complete continuity of pitch, as well as the ability to control pitch movement with great rapidity and precision. Of course the user is also able to emit distinct notes if desired for the musical piece being played.

The stringed musical instrument 110 of the composite instrument 100 is intended to have two modes of operation. First the stringed instrument provides or employs what is known as sympathetic strings, which resonate along with the played notes of the wind instrument 1.

Sympathetic strings or resonance strings are historically identified as auxiliary strings and may be found on many Indian musical instruments, as well as some Western Baroque instruments and a variety of folk instruments. Conventionally sympathetic strings are not played directly by the performer (except occasionally as an effect), only indirectly through the tones that are played on the main strings, based on the principle of sympathetic resonance. The resonance is most often heard when the fundamental frequency of the string is in unison or an octave lower or higher than the catalyst note, although it can occur for other intervals, such as a fifth, with less effect. The musician retunes the sympathetic strings for each mode or raga, so that when the corresponding note (or one an octave below it) is played, the sympathetic strings (sometimes called tarabs in Indian music) will vibrate in response, providing a lingering halo of sound. The sympathetic strings of the instrument 110 differ from conventional sympathetic strings in that the actuating source is not other strings of the stringed instrument (called main strings in that context), but rather from the wind instrument 1 of the composite instrument 100

Further as the wind instrument 1 component is generally operated by one hand the stringed instrument 110 offers a distinct manner of operation and that is through strumming, plucking or bowing of the strings. As known in the art the strings may be separated into main strings that are strummed, plucked or bowed and sympathetic strings that work primarily through the resonance of the main strings. It is noted that some of the "main strings" of the stringed instrument 110 may also serve as sympathetic strings from the tones produced by the wind instrument 1. Further, nothing prevents the musician from strumming, plucking or bowing sympathetic strings, which may be done for enhanced effect.

As shown, the stringed musical instrument 110 may be considered as a psaltery or more broadly as a type of zither. The zither, for the purpose of this application, may be defined as a musical stringed instrument consisting of many strings stretched across a thin, flat body. A zither generally is played by strumming, plucking or bowing the strings. Plucking is effected either with one's fingers, or using a tool called a plectrum and bowing is effected using small bows specially designed for use with zithers or psalteries. Like a guitar or lute, a zither's body serves as a sound box, but unlike the guitar or lute, a zither has no neck. The number of strings varies, from as few as twelve to more than fifty. The stringed instrument 110 may also be formed by an instrument that may be commonly known as a psaltery (as noted above), a guqin, a guzheng (also zheng), an autoharp (note an early description of which in the 1882 patent, U.S. Pat. No. 257,808, which is incorporated herein by reference), a qanun, a kanonaki, a jetigen, a jadagan, a koto, a yatga (also known as a yatug or yatuga), the gayageum (or kayagum), clan tranh, a Kankles, a kokle, a kannel, a kantele, a gusli. These are representative examples all of which can be categorized broadly as types of zithers.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

Various modifications of the present invention may be made without departing from the spirit and scope thereof. For example, as noted above briefly, the stands 3 may be replaced with a user mounted support harness/vest similer to devices that are used by musicians of specialized instruments in a marching band. This mobile/user wearing modification may be useful where the musical instruments 1 or 100 are to be used in jazz presentations, or other implementations requiring mobility to the musician. As repeatedly noted above, the described embodiments are not intended to be restrictive of the present invention. The scope of the present invention is intended to be defined by the appended claims and equivalents thereto.

What is claimed is:

1. A composite musical instrument comprising:

A wind instrument portion wherein the wind instrument portion includes a resonating pipe having a first slot along a length of a longitudinal axis, a sliding rod operatively coupled to the resonating pipe such that the entire rod is moveable in a direction parallel with the longitudinal axis along a length of the first slot, and wherein the sliding rod selectively covers and seals the first slot such that a pitch of sound produced varies according to a length of closure of the first slot; and A stringed musical instrument portion.

2. The composite instrument of claim 1, wherein the wind instrument portion includes a mouthpiece coupled to the resonating pipe.

3. The composite instrument of claim 1, wherein the wind instrument portion includes, a head-joint coupled to the resonating pipe, and a mouthpiece attached to the head-joint.

4. The composite instrument of claim 3 wherein a position of the mouthpiece relative to the player's lips is adjustable by rotation of the mouthpiece.

5. The composite instrument of claim 3, wherein the mouthpiece comprises a tubular chamber having a sealed end and a blow hole.

6. The composite instrument of claim 3, wherein the mouthpiece comprises a vibrating reed.

7. The composite instrument of claim 3, wherein the mouthpiece comprises a fipple.

8. The composite instrument of claim 3, wherein the mouthpiece comprises a lip reed arrangement.

9. The composite instrument of claim 1, wherein the wind instrument portion includes a support stands coupled to each end of the resonating pipe.

10. The composite instrument of claim 9, wherein a height of the support stands is adjustable.

11. The composite instrument of claim 1, wherein the pipe and slot are configured such that the instrument produces at least three octaves of continuous pitch without the need for over-blowing.

12. The composite instrument of claim 1, wherein the wind instrument portion includes a second resonating pipe with a second slot, coupled to the first resonating pipe, operated by a second sliding rod.

13. A slide flute comprising more than one resonating pipes serially attached to one another including a first resonating pipe having a first slot along a length of a longitudinal axis, a sliding rod operatively coupled to the first resonating pipe such that the entire rod is moveable in a direction parallel with the longitudinal axis along a length of the first slot, and wherein the sliding rod selectively covers and seals the first slot such that a pitch of sound produced varies according to a length of closure of the first slot, and a second resonating pipe with a second slot, coupled to the first resonating pipe, operated by a second sliding rod.

14. The slide flute of claim 13, further comprising sound directing baffles coupled to the slide flute.

15. A musical instrument comprising:

a resonating pipe having a first slot along a length of a longitudinal axis;

a sliding rod operatively coupled to the resonating pipe such that the entire rod is moveable in a direction parallel with the longitudinal axis along a length of the first slot, and wherein the sliding rod selectively covers and seals the first slot;

further comprising sound directing baffles coupled to the instrument; and support stands coupled to each end of the resonating pipe.

16. The instrument of claim 15, wherein a height of the support stands is adjustable.

17. The instrument of claim 15, wherein the width of the first slot is adjustable.

* * * * *